US005931765A

United States Patent [19]

Huang

[11] Patent Number: 5,931,765

[45] Date of Patent: Aug. 3, 1999

[54] EXERCISE MACHINE CAPABLE OF SIMULATING BICYCLING

[76] Inventor: Chin-Lien Huang, 2F, No. 14, Ning Hsia E. 5 St., Taichung, Taiwan

[21] Appl. No.: 09/126,773

[22] Filed: Jul. 31, 1998

[51] Int. Cl.[6] ..... A65B 23/04

[52] U.S. Cl. ..... 482/57; 482/57; 482/62

[58] Field of Search ..... 482/57, 60, 62, 482/63, 51, 72

[56] References Cited

U.S. PATENT DOCUMENTS

| | | | |
|---|---|---|---|
| 2,419,998 | 5/1947 | Johnson | 482/62 |
| 3,727,913 | 4/1973 | Glaser et al. | 272/73 |
| 3,940,128 | 2/1976 | Ragone | 272/73 |
| 5,035,419 | 7/1991 | Chen | 272/73 |
| 5,137,501 | 8/1992 | Mertesdorf | 482/57 |
| 5,397,286 | 3/1995 | Chang | 482/62 |
| 5,643,145 | 7/1997 | Lo et al. | 482/57 |

*Primary Examiner*—Stephen R. Crow
*Assistant Examiner*—Tam Nguyen
*Attorney, Agent, or Firm*—Browdy and Neimark

[57] ABSTRACT

An exercise machine is composed of a base, a driving mechanism, a swinging mechanism, a seat, and a handle. The driving mechanism consists of two cranks, a master member and a slave member. The master member is driven by the cranks to actuate the slave member, thereby causing two rocking arms and two rod bodies of the swinging mechanism to swing cyclically and simultaneously in opposite directions. The exercise machine enables an exerciser to engage in bicycling for building the muscles of the chest, belly and legs of the exerciser.

5 Claims, 4 Drawing Sheets

EXERCISE MACHINE CAPABLE OF SIMULATING BICYCLING

FIELD OF THE INVENTION

The present invention relates generally to an exercise machine, and more particularly to a multifunctional exercise machine for building the muscles of the chest, belly and legs of the person.

BACKGROUND OF THE INVENTION

There are a variety of multifunctional exercise machines available in the market place today. These conventional multifunctional exercise machines are intended for use in building the muscles of various parts of a human body and are rather complicated in construction. In addition, the conventional multifunctional exercise machines are too cumbersome to be used in a private home in which an available space for the conventional multifunctional exercise machine is hard to come by.

SUMMARY OF THE INVENTION

The primary objective of the present invention is therefore to provide an exercise machine capable of simulating a bicycling motion for developing the muscles of the chest, belly, and legs of a person.

In keeping with the principle of the present invention, the foregoing objective of the present invention is attained by an exercise machine consisting of a base, a driving mechanism, a swinging mechanism, a seat, and a handle. The exercise machine enables an exerciser to engage in bicycling for building the muscles of chest, belly and legs of the exerciser.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
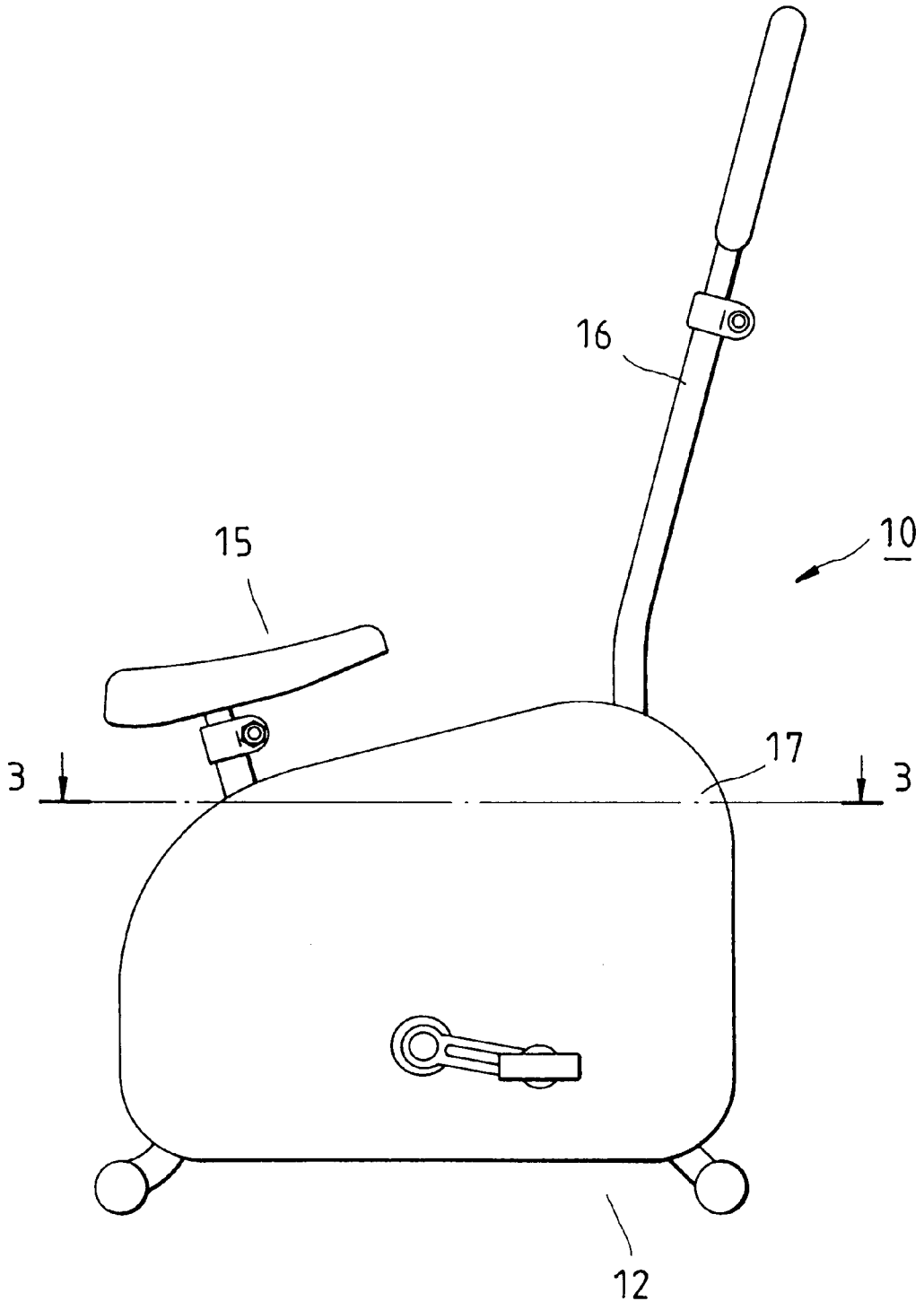
FIG. 1 shows a side view of the preferred embodiment of the present invention.
Figure 2:
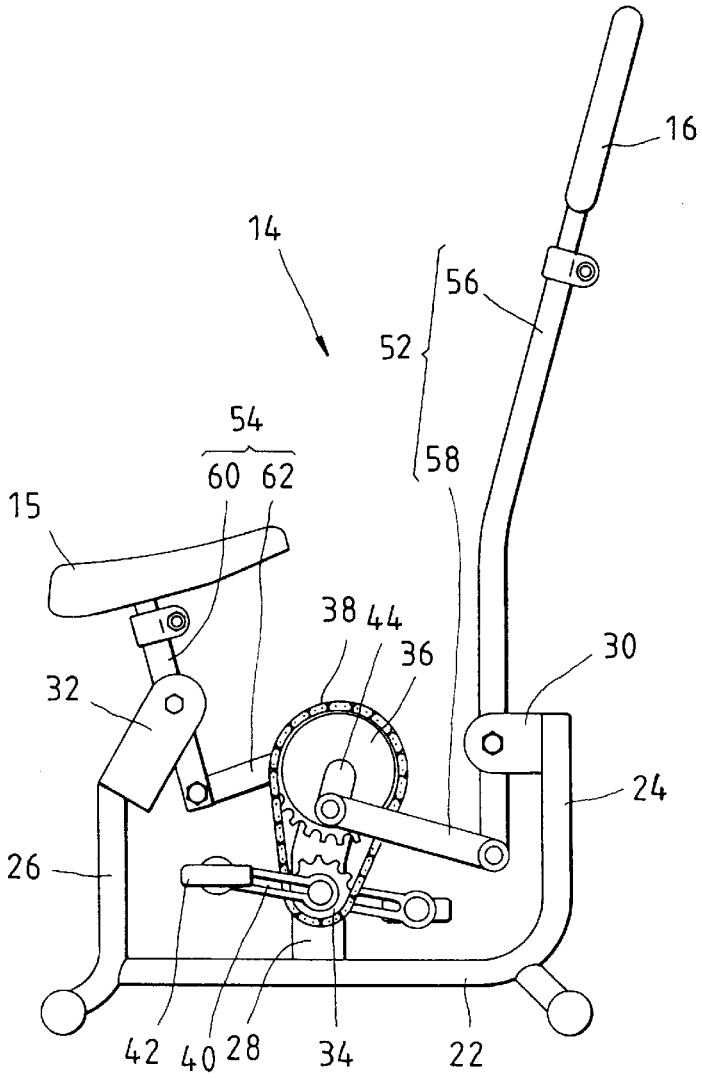
FIG. 2 is a side schematic view revealing an internal construction of the preferred embodiment of the present invention.
Figure 3:
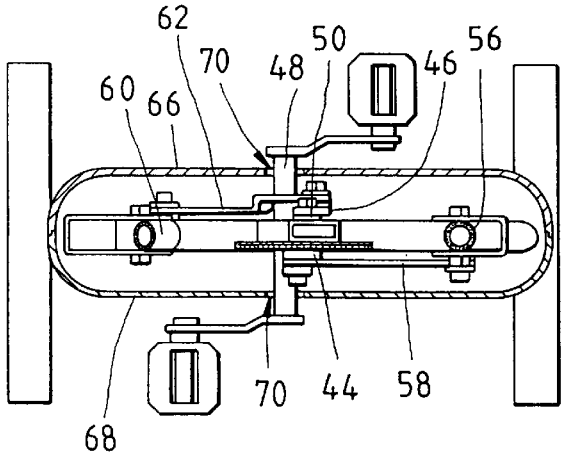
FIG. 3 shows a sectional view of a portion taken along the direction indicated by a line 3—3 as shown in FIG. 1.

As shown in FIGS. 1–3, an exercise machine 10 embodied in the present invention is composed of a base 12, a driving mechanism 13, a swinging mechanism 14, a seat 15, and a handle 16.

The base 12 is made up of a support body 22, two upright rods 24, 26 which are fastened with the support body 22 by welding, a support rod 28 having a radian and welded to the center of the support body 22, and two pivoting seats 30 and 32 which are respectively welded to the two upright rods 24 and 26.

The driving mechanism is composed of a master member 34, a slave member 36, a transmission member 38, two cranks 40, two pedals 42, and two eccentric blocks 44 and 46. The master member 34 and the slave member 36 are respectively a gear and are fastened pivotally with the support rod 28 by a shaft 48, 50. The diameter ratio of the master member 34 and the slave member 36 is about 1:2. The master member 34 and the slave member 36 are linked by the transmission member 38, which is a chain. The two cranks 40 are fastened with both ends of the shaft 48 such that the cranks 40 are respectively provided with the pedal 42 fastened pivotally therewith. The two eccentric blocks 44 and 46 are fastened with the shaft 50 such that the eccentric blocks 44 and 46 are opposite in location to each other.

The swinging mechanism 14 is composed of a first and a second swinging units 52 and 54. The first swinging unit 52 has a first rod body 56 of a hollow construction and fastened pivotally with the first pivoting seat 30. The first rod body 56 has a curved top end. The first swinging unit 52 further has a first rocking arm 58 which is fastened pivotally at one end thereof with the first eccentric block 44, and at other end thereof with the bottom end of the first rod body 56. The second swinging unit 54 has a second rod body 60 of a hollow construction and fastened pivotally with the second pivoting seat 32. The swinging unit 54 further has a second rocking arm 62 which is fastened pivotally at one end thereof with the second eccentric block 46, and at other end thereof with the bottom end of the second rod body 60.

The seat 15 is mounted on the second rod body 60. The handle 16 is fastened with the first rod body 56.

The exercise machine 10 of the preferred embodiment of the present invention is further composed of a housing 17 which is formed of a first housing portion 66 and a second housing portion 68. The first housing portion 66 and the second housing portion 68 are provided with a through hole 70 through which the two cranks 40 are jutted out of the housing 17. With the exception of the seat 15 and the first rod body 56, all component parts of the exercise machine 10 of the present invention are shielded by the housing 17.

In operation, the master member 34 is actuated by the cranks 40 so as to actuate the slave member 36, thereby resulting in the movement of the eccentric blocks 44 and 46. The first rocking arm 58 and the second rocking arm 62 are thus capable of actuating the first rod body 56 and the second rod body 60 to bring about the opposite swinging motions of the handle 16 and the seat 15.

Figure 4:
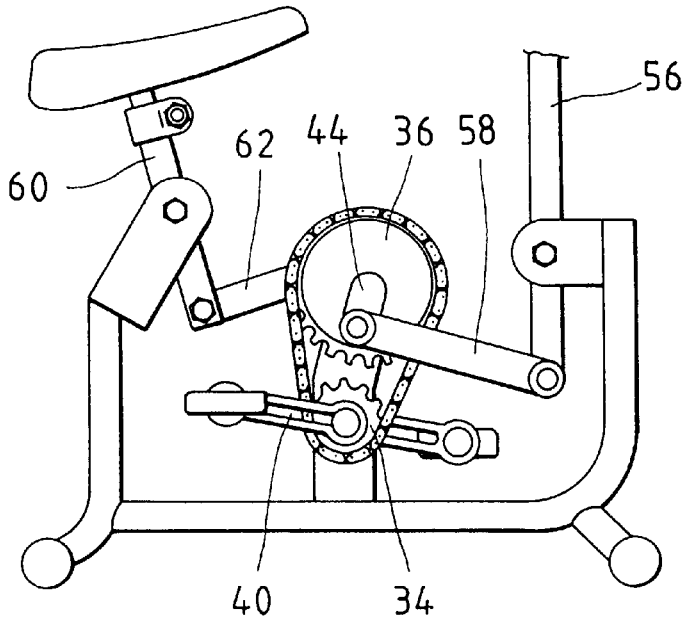
FIGS. 4–7 show schematic views of the preferred embodiments of the present invention at work.
Figure 5:
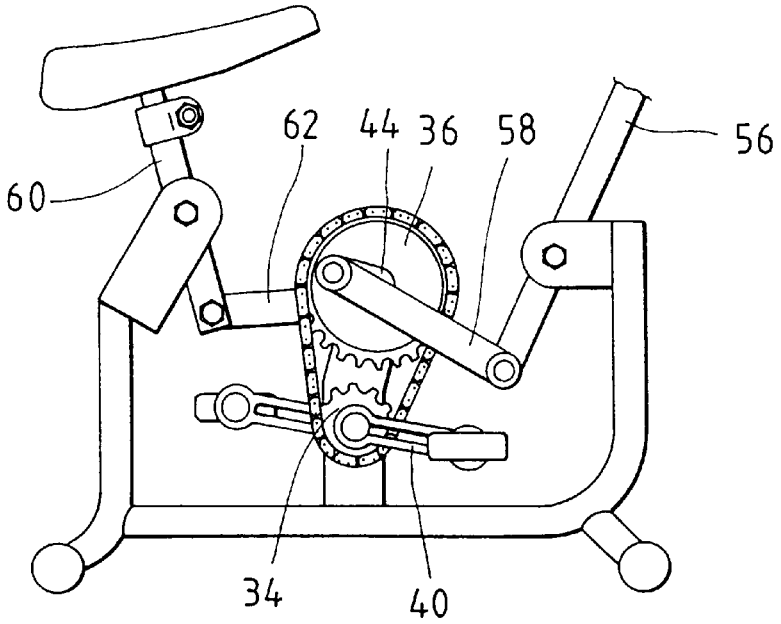
Figure 6:
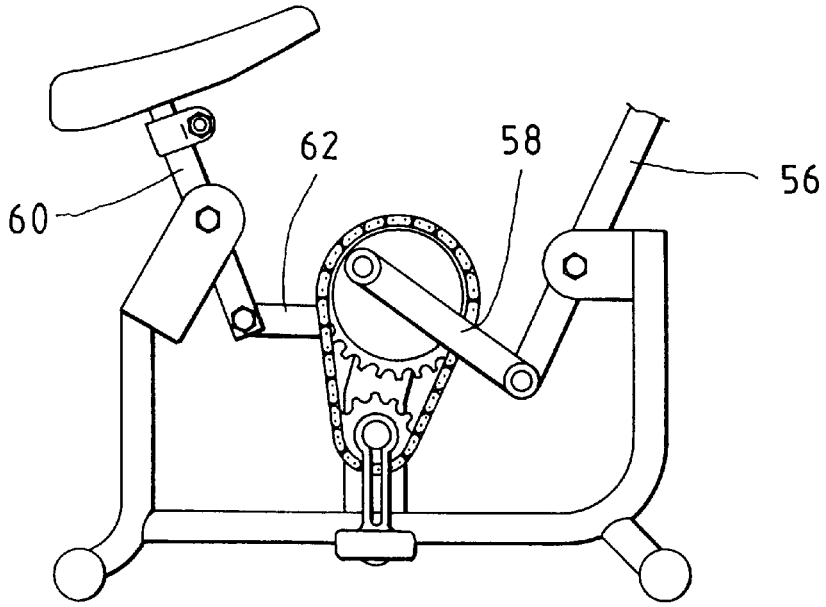
Figure 7:
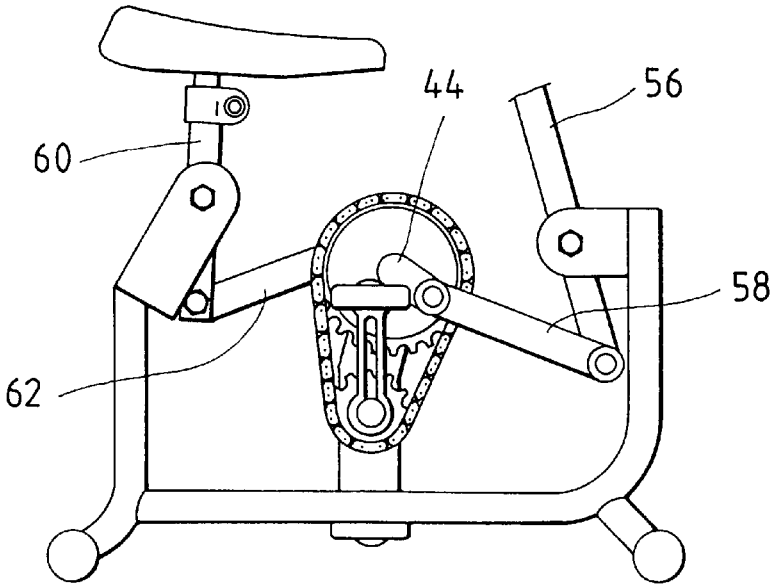

As illustrated in FIGS. 4 and 5, when the master member 34 is actuated by the cranks 40 to rotate a full circle, the slave member 36 turns only a half circle, thereby causing the eccentric blocks 44 and 46 to move in opposite directions to push the first and the second rocking arms 58 and 62. As a result, the first and the second rod bodies 56 and 60 are driven to swing in opposite directions. Now referring to FIGS. 6 and 7, when the master member 34 rotates two full circles, the slave member 36 is actuated to turn only one full circle, thereby causing the eccentric blocks 44 and 46 to rotate one full circle to push the first and the second rod bodies 56 and 60 to swing once again in opposite directions. The swinging speed of the first and the second rod bodies 56 and 60 is directly proportional to the rotational speed of the pedals 42. It is therefore readily apparent that the exercise device 10 of the present invention is capable of building the muscles of the chest, belly and legs of a user thereof.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An exercise machine comprising:

a base made up of two upright rods and a support rod located between said two upright rods, said two upright rods provided respectively with a pivoting seat fastened therewith;

a driving mechanism composed of a master member and a slave member linked with said master member by a transmission member, two cranks fastened with both ends of said master member, two pedals fastened respectively with a free end of said two cranks, and two eccentric blocks fastened with both ends of said slave member;

a swinging mechanism composed of a first swinging unit and a second swinging unit, said first swinging unit having a first rod body which is fastened pivotally with one of said pivoting seats, said first swinging unit further having a first rocking arm which is fastened pivotally at one end thereof with one of said eccentric blocks and at other end thereof with a bottom end of said first rod body, said second swinging unit having a second rod body which is fastened pivotally with other said pivoting seat, said second swinging unit further having a second rocking arm which is fastened pivotally at one end thereof with said eccentric block and at other end thereof with a bottom end of said second rod body;

a seat mounted on said second rod body; and a handle fastened with said first rod body;

said cranks being actuated by said pedals in motion such that said master member is driven to actuate said slave member, thereby causing said eccentric blocks to drive said first rocking arm and said second rocking arm to swing in opposite directions so as to enable said first rod body and said second rod body to swing cyclically and simultaneously in opposite directions.

2. The exercise machine as defined in claim 1 further comprising a housing mounted on said base such that said upright rods, said support rod, said driving mechanism and at least part of said swinging mechanism are enclosed by said housing, said housing provided with two through holes via which said cranks are jutted out of said housing.

3. The exercise machine as defined in claim 1, wherein said master member and said slave member are mounted respectively on a shaft.

4. The exercise machine as defined in claim 3, wherein said cranks are fastened with both ends of said shaft on which said master member is mounted.

5. The exercise machine as defined in claim 1, wherein said master member is a gear; wherein said slave member is a gear; and wherein said transmission member is a chain.

* * * * *